US006055978A

United States Patent [19]

Ellis

[11] Patent Number: 6,055,978

[45] Date of Patent: May 2, 2000

[54] FIREPLACE LOG RETAINER

[76] Inventor: Charles D. Ellis, 1023 Jones Martin Rd., Lincolnton, Ga. 30817

[21] Appl. No.: 09/108,207

[22] Filed: Jul. 1, 1998

[51] Int. Cl.[7] ..... F23B 1/193

[52] U.S. Cl. ..... 126/541; 126/298; 126/152 B

[58] Field of Search ..... 126/541, 542, 126/298, 163 R, 163 A, 540, 152 R

[56] References Cited

U.S. PATENT DOCUMENTS

| | | | |
|---|---|---|---|
| 2,762,363 | 9/1956 | Hager . | |
| 2,926,657 | 3/1960 | Ford . | |
| 3,612,034 | 10/1971 | Wood | 126/541 |
| 4,019,493 | 4/1977 | McCullough | 126/541 |
| 4,166,447 | 9/1979 | Creim . | |
| 4,262,651 | 4/1981 | Fajt . | |
| 4,338,916 | 7/1982 | Vaughn . | |
| 4,360,001 | 11/1982 | Thompson | 126/298 |

*Primary Examiner*—James C. Yeung
*Attorney, Agent, or Firm*—Clark & Brody

[57] ABSTRACT

A log retainer has a two or more mounting brackets connected together by a cross bar. Each mounting bracket has a lower and upper mounting arm which is used to connect the retainer to the grate without adapting the grate. Each of the lower mounting arms has fingers extending therefrom, and each of the upper mounting arms has a thumb extending therefrom, the fingers and thumb engaging members of the grate to support the mounting brackets and cross bar above the grate to retain the logs in the grate.

19 Claims, 2 Drawing Sheets

FIG. 1
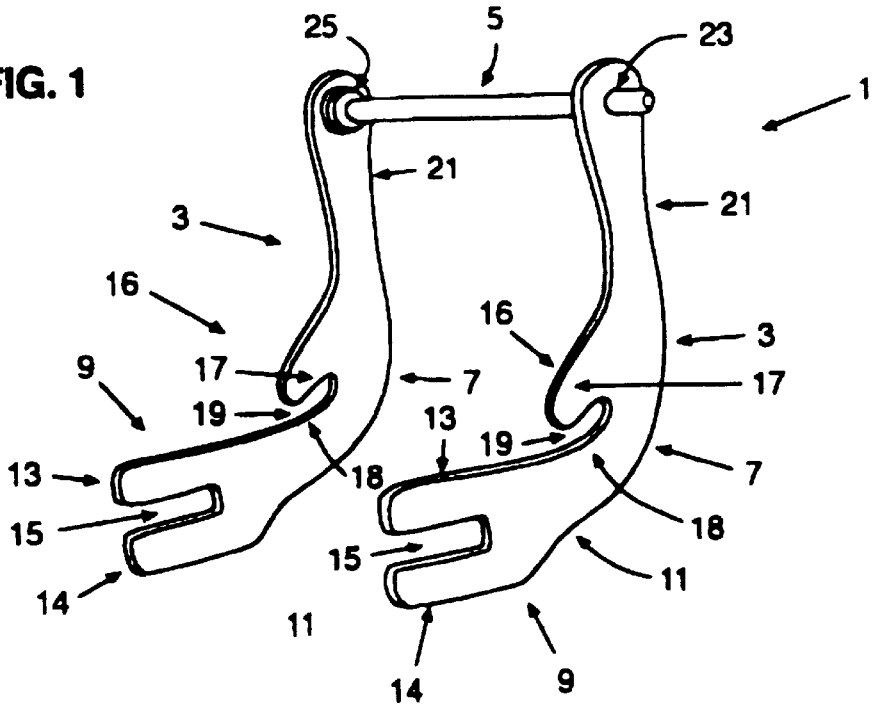
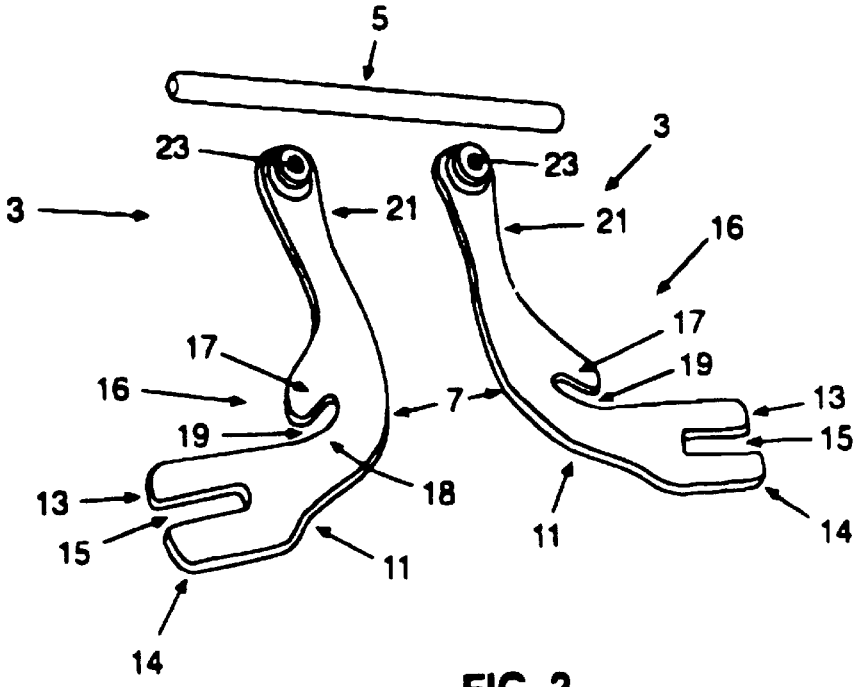
FIG. 2

FIREPLACE LOG RETAINER

FIELD OF THE INVENTION

The present invention relates to the field of fireplace safety devices, and in particular, to a log retainer that can be used in conjunction with existing fireplace grates.

BACKGROUND OF THE INVENTION

Fireplaces are traditionally fueled by burning wood, such as wooden logs, etc. Fireplace grates are commonly used to elevate the wood in the fireplace to allow needed oxygen to circulate around it, particularly underneath and around the sides and back, which aids in creating and maintaining the fire. Grates also typically have multiple spaces or slits therein for allowing ashes to fall through and separate from the unburned wood. An elevated grate also allows the fireplace to be cleaned without removing the grate.

Various hazards are associated with burning wooden logs on a grate. For example, placing too many wooden logs onto the grate creates the possibility that they will roll off and fall out of the fire box. This possibility arises because of the desire to provide easy access to the fireplace to allow one to start and maintain the fire. Thus, the typical grate does not have a barrier to prevent logs from rolling and/or falling off. When burning logs settle, however, the logs can roll or fall out, possibly spreading fire and/or injuring those nearby. Moreover, to obtain increased heat output during cold weather, a significant amount of wood is often piled onto the grate, thereby increasing the risk of an accident.

Efforts have been made to prevent logs from rolling and/or falling out of the fireplace. This has been only marginally successful, however, due to the expense and difficulty of constructing or using the necessary devices. For example, U.S. Pat. No. 2,762,363 issued to H. A. Hager, shows a log loading andiron, which pivots about a rod that must be connected via holes formed in the grate frame. Also, U.S. Pat. No. 4,262,651 issued to Fajt, shows a fireplace log guard that is mounted on a piston-like mechanism which, in turn, must disadvantageously be welded to the front of the grate. U.S. Pat. No. 2,926,657 issued to P. H. Ford, shows a grate having integral grate bars that extend upward and pivot about other grate supports. A disadvantage of all of these devices is that they cannot be used in conjunction with conventional fireplace grates without making substantial adaptations to the grate. While U.S. Pat. No. 4,338,916 issued to Vaughn, teaches a device, which rests between the grate and floor, the device cannot be secured to the grate and blocks access to the area underneath the grate and precludes easy cleaning of the fireplace.

SUMMARY OF THE INVENTION

The present invention relates to a fireplace log retainer that can be easily mounted on conventional fireplace grates without making adaptations to the grate. The log retainer advantageously has mounting sections that enable it to be easily mounted and extended upward above the front of an existing grate, as well as to be easily removed. The present invention can also be disassembled and its sections used alone or extended, if desired, for grates of different sizes. The log retainer of the present invention makes it possible not only to retain the wood on the grate, but also to stoke the fire, and remove logs without removing the retainer.

The present invention generally comprises two, substantially identical mounting arms connected by a cross member, wherein the mounting arms extend substantially perpendicular to the cross member. Each of the mounting arms is preferably in the shape of a substantial "J" shape, with an upper attachment portion extending substantially vertically, an intermediate mounting section on the turn portion, and a lower mounting section extending substantially horizontally outward therefrom. The upper attachment portion preferably has a hole into which the cross member can be inserted and secured by set screws. The intermediate mounting section preferably comprises a thumb section extending outward from the inside portion of the turn, wherein a space is thereby formed. The lower mounting section preferably comprises a hand section with two fingers extending outward forming a second space between them.

The present invention can be used in conjunction with conventional fireplace grates having a lattice-like supporting surface with two slanted side walls and a floor, wherein the surface has parallel spaces and supports extending from front to back and side-to-side. Extending horizontally along the upper edge of the walls and along the floor of the grate are two support sections on each side. The upper and lower support sections which run side-to-side and multiple and spaced support members which run front-to-back form a lattice of metal bars, wherein multiple slits and spaces are formed into which the present invention can be inserted.

The log retainer of the present invention is connected to an existing grate of this type by positioning the mounting arms in front of the grate with the lower mounting sections facing toward the front wall. In this manner, the two fingers extending from each of the lower mounting sections can be extended into the grate by sliding them between the support members and into the slits. That is, each pair of fingers can be extended into the grate such that they extend above and below the lower horizontal support section. In this manner, the lower support section is positioned inside the space between the two fingers, and the lower mounting section on each arm is braced against the support members which support the mounting arm in relation to the grate. To complete the mounting of the log retainer, the thumb section of each of the mounting arms is placed substantially over the upper support section. The log retainer can, in this manner, be mounted to the grate such that the upper attachment portion of the mounting arm extends substantially upright, wherein the mounting arms and cross member together serve to prevent logs from rolling or falling off the grate.

The log retainer of the present invention can also be separated into three pieces by, for example, unscrewing the set screws. In fact, if desired, each of the mounting arms can be separated from the cross member and used as a separate log retainer, or together with other substantially identical mounting arms to form a series of log retainers, with or without the cross member attached. Using the mounting arms without the cross member has the advantage of providing better access to the fireplace, which can be helpful when using relatively large logs. Multiple sets of substantially identical log retainers of the present invention can also be used side-by-side for relatively large or long fireplace grates. Moreover, three or more mounting arms can be secured to a single longer cross member if desired. Adapters can also be used to change the shape of the spaces on the mounting arms, such that they conform more closely to the shapes of the upper and lower support sections on the grate.

BRIEF DESCRIPTION OF THE DRAWINGS

FIG. 1 is a perspective view showing the present invention in its assembled state with two mounting arms extending downward from the cross member;

FIG. 2 shows the present invention in its unassembled state with two mounting arms laying on their sides with the cross member.

DETAILED DESCRIPTION OF THE INVENTION

Figure 3:
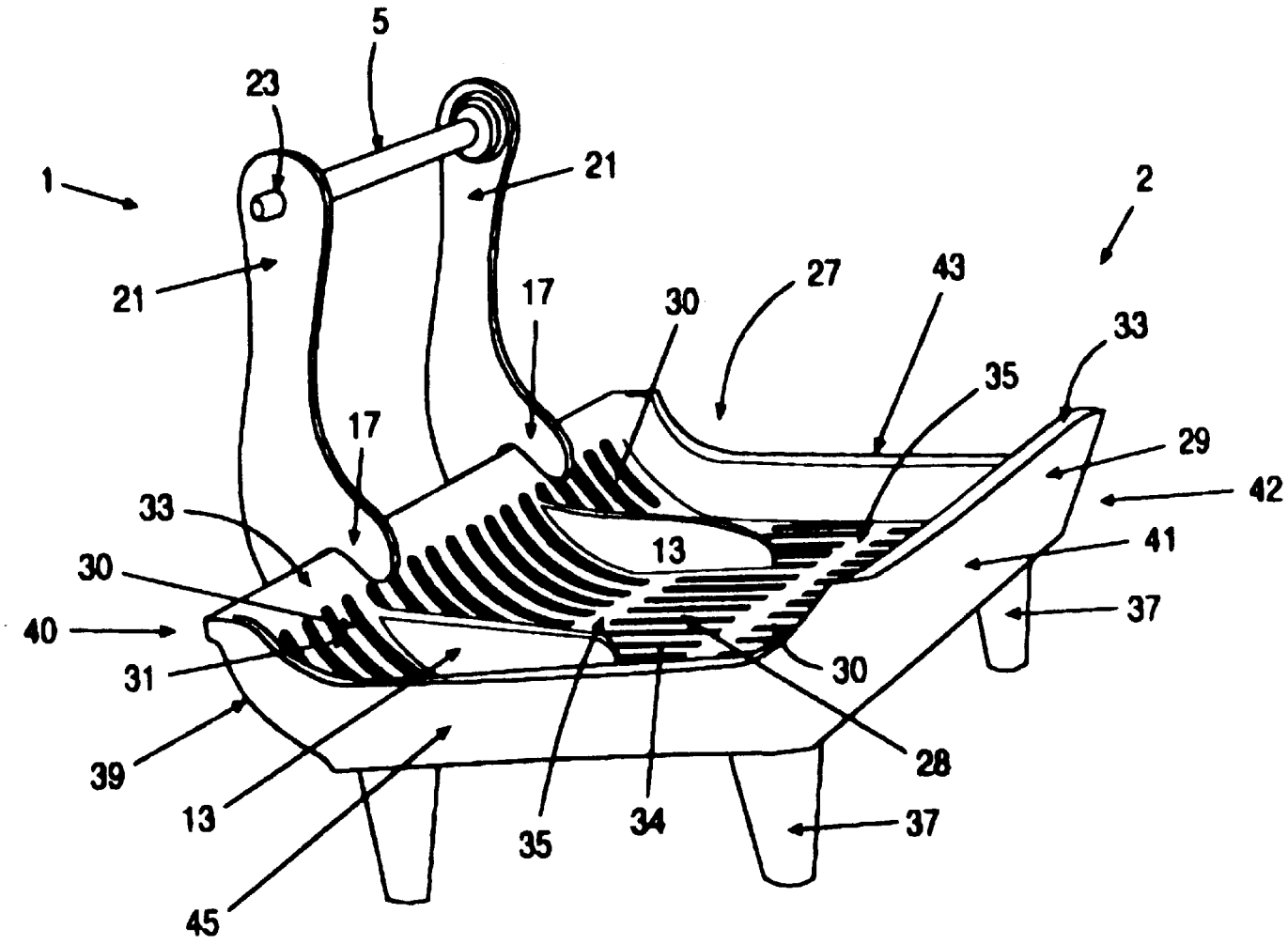
FIG. 3 is a perspective view showing the present invention mounted to the front of a conventional fireplace grate.

FIG. 1 shows the log retainer 1 of the present invention in perspective view having a cross member 5, which can be any bar-like member, and two substantially identical mounting arms 3 extending perpendicularly therefrom. Each of the mounting arms 3 has an upper attachment portion 21 with an aperture or hole 23 therein. The hole 23 is preferably adapted in size and shape to allow the cross member 5 to be inserted therein in a relatively snug manner. While the relatively snug fit between the cross member 5 and hole 23 preferably allows them to be secured by friction alone, the mounting arms 3 can also be provided with one or more set screws 25 for removably securing the mounting arms 3 to the cross member 5. The mounting arms 3 can be adapted to slide along the length of the cross member 5 to adjust the distance between them. In the preferred embodiment, the mounting arms are mounted substantially on opposite ends of the cross member 5, as shown in FIG. 1.

Each of the mounting arms 3 is substantially in the shape of a "J", as shown in FIGS. 1 and 2. The upper portion 21 extends substantially upright and then extends substantially downward toward an intermediate mounting section 16 which is located substantially on or near a turn 7. The intermediate mounting section 16 generally comprises a thumb section 17 which extends relatively downward and outward at an angle on the inside portion 18 of the turn 7. The thumb section 17 and inside portion 18 are adapted to form a first space 19.

Extending below the intermediate mounting section 16 is a lower mounting section 9 which generally comprises a hand section 11 and two finger sections 13 and 14 extending outwardly therefrom. The two finger sections 13, 14 preferably extend horizontally and substantially perpendicular to the upper portion 21. The two fingers 13, 14 form a space 15 therebetween, which is open on the distal end thereof. The space 15, like the two fingers 13, 14, is preferably substantially horizontal and extends substantially perpendicular to the upper portion 21.

The mounting arms 3 and cross member 5 are preferably made of a substantially rigid, as well as heat and fire resistant, material, such as extruded or formed steel or metal. The log retainer may also be made from the same material as the grate 2, to match the appearance and strength of the grate.

The typical grate 2 upon which the present invention is designed to be mounted, as shown in FIG. 3, has a lattice-like supporting surface 27 having a floor 28 and two angled walls 40, 42 extending along the front 39 and back 41 side. The grate 2 is constructed of rigid support members that are laterally and longitudinally oriented to provide multiple slits 31, 34 that extend from front-to-back. The slits are provided to enable air to circulate properly around the wood from all sides as is needed to start and maintain the fire. The slits are also provided to allow ashes to fall through, enabling the unburned portion of the wood to be easily separated therefrom. In this respect, the grate 2 is preferably elevated above the fireplace floor by legs 37 which extend from the bottom of the floor 28 to provide better access to the area under the grate, such as for cleaning, air circulation, etc.

The supporting surface 27 is generally comprised of multiple support members 30 that extend substantially parallel to one another from front 39 to back 41. The support members 30 are preferably relatively narrow and have spaces therebetween that form narrow multiple slits 31, 34 such as that illustrated between adjacent support members 30.

On the upper lateral edges of the front and back walls 40, 42 are two upper support sections 33 which extend side-to-side, from the left side 43 of the grate to the right side 45. Also extending parallel to the upper support sections 33 in the same direction are two or more lower support sections 35 which are located on or near the floor 28 of the grate. The upper and lower support sections 33, 35 intersect the parallel support members 30 along the upper and lower portions of the grate, respectively, to form a lattice-like supporting surface 27.

The mounting arms 3 are configured to enable the log retainer to be easily mounted onto the type of grate described above. To connect the log retainer 1 of the present invention to the grate 2, the log retainer 1 is preferably positioned in front of the grate with the cross member 5 substantially horizontal and the lower mounting sections 9 of the mounting arms 3 facing toward the front wall 40 of the grate 2. In this manner, each of the lower mounting sections 9 can be extended through the front wall 40 by sliding the finger sections 13 and 14, respectively, above and below the corresponding lower support section 35. In this manner, upper fingers 13 are slid into the corresponding slits 31, such that the lower support section 35 is positioned within the space 15 between the two finger sections 13 and 14.

Once the lower mounting sections 9 are inserted into the grate, the thumb sections 17 are positioned over the front wall 40 and onto the upper support section 33, such that the thumb sections 17 rest on top of the front wall 40. In this manner, the lower mounting section 9 is braced by the lower support section 35 and adjacent support members 30, and the intermediate mounting section 16 is braced upon the upper support section 33, to maintain the mounting arms 3 substantially upright in relation to the grate. That is, because the thumb sections 17 extend outward and downward over the front wall 40, and the lower mounting sections 9 are braced against the lower support section 35 and between the support members 30 of the grate, the mounting arms 3 are connected in a manner that provides support and resists movement of the logs forward, i.e., such as when the logs are piled up too high on the grate.

The mounting arms 3 are preferably constructed from a relatively flat piece of material such that they are relatively planar. In this respect, the mounting arms 3 are relatively thin which advantageously allows them to be inserted into the relatively narrow slits 31 in the grate 2. The mounting arms 3 are preferably narrow enough to fit easily between the support members 30, but also wide enough that they can be laterally supported by the support members 30. The planar shape of the mounting arms also enables them to have their greatest width in the direction needed to resist the greatest bending moments that might be applied by the logs on the grate.

The mounting arms 3 are also preferably selectively positioned along the length of the cross member 5 to change the distance between them and/or the position of the mounting arms in relation to the cross member 5. That is, they can be adjusted so that the distance between them corresponds with the distance between the corresponding slits 31. Such adjustments are preferably made either with or without the aid of the set screws 25.

Certain variations can be provided without departing from the scope of the present invention. For example, both of the spaces 15 and 19 on the arms 3 can be configured to properly conform to the shape of the corresponding upper and lower support sections 33, 35 for more secure mounting. That is, the spaces can be rounded to conform to support sections 33, 35 that are rounded, or they can be squared to conform to support sections 33, 35 that are squared. In either case, the spaces 15, 19 are preferably large enough such that support sections 33, 35 having varying sizes can be mounted thereto. Adapters (not shown) can also be provided to better conform the shape of the spaces to the upper and lower support sections.

While the embodiment shown has two mounting arms 3, the present invention can be provided with additional mounting arms if necessary for larger/longer grates. In such a case, a single, longer cross member 5 can be provided on which the multiple mounting arms 3 can be secured. The present invention can also be used without the cross member 5. For example, when relatively long, well-shaped logs are used, the mounting arms 3 by themselves may be mounted to the grate to maintain the logs. Indeed, in some cases, even a single mounting arm may be sufficient to hold the logs on the grate. An advantage of not using the cross member 5 is that access to the fireplace is improved. The mounting arms 3 preferably can be removed from the cross member 5 simply by sliding the mounting arms off. They are otherwise held by friction alone, or, when set screws 25 are used, by tightening the screws.

Mounting arms 3 having different configurations are also possible. For example, if the raised walls 40, 42 of the grate are more upright, the lower mounting section 9 can be shorter. The relative spatial positioning of the upper and lower support sections 33, 35 on the grate will, to a large extent, determine the appropriate spatial positioning of the lower and intermediate mounting sections 9, 16. Moreover, all of the mounting arms 3 do not necessarily have to be substantially identical in shape. As long as they serve the same function, i.e., are capable of being mounted to the grate, they can be provided in virtually any configuration.

What is claimed is:

1. A device for use on a fireplace grate to retain logs thereon, comprising:

two or more arm members connected together by a cross member, each of said arm members having a lower mounting bracket, an intermediate mounting bracket and an upper portion;

said lower mounting bracket comprising a hand section with two fingers extending therefrom forming a first space therebetween, and said intermediate mounting bracket comprising a thumb section which forms a second space thereon; and wherein said two fingers on said lower mounting bracket are adapted to engage a lower section of said fireplace grate, and said thumb section on said intermediate mounting bracket is adapted to engage an upper section of said fireplace grate, wherein each of said arm members is adapted to be removably connected to and extended above said fireplace grate.

2. The device of claim 1, wherein said arm members are removably connected to said cross member by friction alone.

3. The device of claim 1, wherein said arm members are removably connected to said cross member by set screws.

4. The device of claim 1, wherein each of said arm members is substantially flat and extends along a plane that extends substantially perpendicular to said cross member.

5. The device of claim 1, wherein each of said arm members has a turn portion wherein said thumb section extends from the inside of said turn portion.

6. The device of claim 1, wherein said two fingers are extended in a direction that is substantially perpendicular to said upper portion.

7. The device of claim 1, wherein said first space is adapted such that said lower section of said grate can be positioned therein, and said second space is adapted such that said upper section of said grate can be positioned therein.

8. The device of claim 1, wherein said first and/or second spaces are substantially rounded in configuration.

9. The device of claim 1, wherein said first and/or second spaces are substantially squared in configuration.

10. The device of claim 1, wherein one or more adaptors are provided which can be inserted in and connected to said first and/or second spaces to change the configuration thereof, such that said spaces can conform to the shape of said upper and lower sections of said grate.

11. The device of claim 1, wherein each of said upper portions of said arm members is provided with a hole into which said cross member can be inserted and slidably engaged.

12. A log retainer for use on a fireplace grate, comprising:

one or more mounting sections, each of said one or more mounting sections having thereon a lower connecting arm and an upper connecting arm;

said lower connecting arm being adapted to engage a first section of said grate, and said upper connecting arm being adapted to engage a second section of said grate, wherein each of said one or more mounting sections is adapted to be removably connected to said grate such that it extends upward in relation to said grate to retain logs thereon, wherein said lower connecting arm comprises a hand section with two fingers extending therefrom, and said upper connecting arm comprises a thumb section, said two fingers of said lower connecting arm are adapted to engage and be positioned above and below said first section of said grate, and said thumb section is adapted to extend subtancially over said second section of said grate.

13. The retainer of claim 12, wherein two mounting sections are provided and a cross member is extended and removably connected between said mounting sections.

14. The retainer of claim 13, wherein said cross member extends along a first axis and each of said mounting sections extends substantially along a plane that is perpendicular to said first axis.

15. The retainer of claim 12, wherein each of said mounting sections is configured such that said two fingers extend substantially perpendicular to the upper portion of said mounting sections.

16. The retainer of claim 12, wherein during use said two fingers can be extended substantially horizontally such that they can be slid substantially horizontally above and below said first section of said grate.

17. The retainer of claim 12, wherein a first space is formed between said two fingers, and a second space is formed by said thumb section, wherein said first and second spaces are sized to enable said first and second sections, respectively, of said grate to be inserted therein.

18. The retainer of claim 12, wherein said grate has a supporting surface comprising multiple support members which are interconnected to said first and second sections of said grate, wherein to connect said one or more mounting sections onto said grate, each of said one or more mounting sections is positioned between two of said support members, wherein said support members provide lateral support to said mounting sections.

19. A fireplace grate capable of retaining logs thereon, comprising:

a grate member having a supporting surface for supporting said logs thereon, said supporting surface comprising multiple support members with slits therebetween extending from front to back, and upper and lower support sections connected to said support members extending side-to-side substantially perpendicular to said support members;

a removable log retainer for retaining logs on said grate member, said log retainer comprising a cross member with two or more mounting sections extending therefrom, wherein each of said mounting sections has a lower and upper mounting arm thereon; and wherein each of said lower mounting arms is adapted to slide between two adjacent multiple support members and engage said lower support section of said grate member, and said upper mounting arm is adapted to engage said upper support section of said grate member, wherein each of said upper and lower mounting sections is capable of being removably positioned on said grate member such that said log retainer extends substantially upward from said grate member to help retain logs thereon.

* * * * *